United States Patent [19]

Yung

[11] Patent Number: 4,891,911

[45] Date of Patent: Jan. 9, 1990

[54] SLIDING DOOR CLOSING DEVICE

[76] Inventor: Victor J. L. Yung, 834 September Dr., Cupertino, Calif. 95014

[21] Appl. No.: 325,196

[22] Filed: Mar. 17, 1989

[51] Int. Cl.[4] ..... E05D 15/06; E05F 1/00

[52] U.S. Cl. ..... 49/404; 16/81

[58] Field of Search ..... 49/404, 387; 16/81

[56] References Cited

U.S. PATENT DOCUMENTS

| | | | |
|---|---|---|---|
| 621,670 | 3/1899 | Hinds | 49/387 X |
| 1,024,059 | 4/1912 | Brintnall | 49/387 X |
| 3,334,444 | 8/1967 | Hargrove | 49/404 |
| 4,003,102 | 1/1977 | Hawks et al. | 16/81 X |
| 4,126,912 | 11/1978 | Johnson | 49/404 X |
| 4,649,598 | 3/1987 | Kinsey et al. | 16/81 |

FOREIGN PATENT DOCUMENTS

| | | | |
|---|---|---|---|
| 863182 | 2/1971 | Canada | 49/404 |

*Primary Examiner*—Philip C. Kannan
*Attorney, Agent, or Firm*—Owen, Wickersham & Erickson

[57] ABSTRACT

An automatic closing device adapted for attachment to a sliding door having upper and lower horizontal frame members and supported between upper and lower track members is disclosed. The closing device comprises an elongated tubular member containing a counterweight that maintains an air tight seal as it moves up and down within the tubular member. A flexible cable attached at one end to the counterweight is anchored at its opposite end to an upper track member at a preselected location. An upper end element fits into the tubular member and has a pulley wheel for supporting the cable between its ends. A lower end element that fits into the lower end of the tubular member forms an air tight seal for a variable chamber below the counterweight. This lower end element has a check valve for allowing outside air to flow into the chamber while preventing air from flowing out of the chamber and it also supports a separate, adjustable bleed valve for allowing air to flow out of the chamber at a restricted rate so as to control the downward travel of the counterweight within the tubular member when the door is closing.

9 Claims, 2 Drawing Sheets

SLIDING DOOR CLOSING DEVICE

This invention relates to an automatic closing device for sliding doors and more particularly to one that can be easily attached for use on existing sliding door installations.

BACKGROUND OF THE INVENTION

Sliding doors used in many homes and other small buildings are generally relatively heavy units comprised of a metal frame supporting a plate glass pane and movable within tracks supported between the floor and ceiling. For reasons such as convenience, heat conservation and safety, it is desireable to provide some power assist that will automatically close the door after it has been opened. Previous attempts to provide this feature are shown in U.S. Pat. Nos. 4,649,598, 4,003,102 and 3,334,444. All of these prior art devices utilize the general principle of a counterweiqht to provide a gravity assisted closing force. However, in each case they involved complicated mechanisms that were either overly expensive to manufacture and/or difficult to install and service.

Among the objects of the present invention are to provide an improved sliding door automatic closure device that can be installed to an existing door assembly without the need for special tools; that can be readily adjusted by an externally accessible control to optimize its operation; that is cosmetically compatible with the door on which it is installed; and that is particularly well adapted for ease and economy of manufacture.

SUMMARY OF THE INVENTION

In accordance with the principles of the invention an automatic door closing device is provided which is adaptable for a relatively simple installation adjacent to one vertical end frame member of a conventional sliding door that is at the opposite end from the vertical end frame having the door handle and latch or lock. The closing device comprises a straight housing section, preferable having a square or rectangular cross-section and containing an elongated movable counterweight. The latter is provided with sealing means at opposite ends which allow movement of the counterweight within the housing but prevent any passage of air past the counterweight as it moves therein. This enables an air chamber in the housing below the counterweight to help control its movement in closing the doors.

At opposite ends of the housing are a pair of upper and lower plug members that fit into and are easily assembled with the housing. The upper plug member provides a mounting support for a pulley wheel around which a cable from the counterweight extends. The other end of the cable is adapted to be anchored in the frame for the sliding door at the opposite location. The lower plug member provides an air-tight closure for the bottom end of the housing and has a first port with a check valve to allow air to flow into the air chamber below the counterweight in the housing and a second port with a controllable or selectable orifice to provide for air outflow at a desired rate as the counterweight moves lower in the housing when the door is closing. The housing, counterweight and the upper and lower plug members are all formed so as to be manufactured at a minimal cost and to be easily assembled to provide a smooth-operating door closing installation.

Other objects, advantages and features of the present invention will become apparent from the following detailed description of one embodiment thereof, presented in conjunction with the accompanying drawing.

DETAILED DESCRIPTION OF EMBODIMENT

Figure 1:
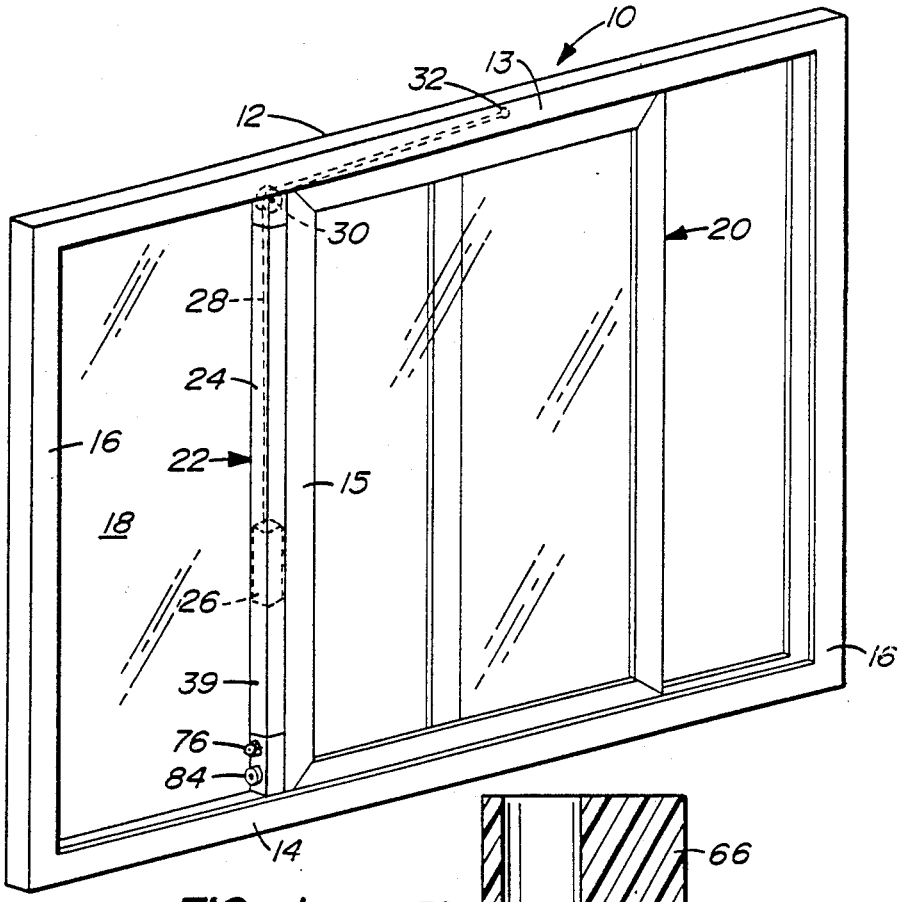
FIG. 1 is a view in perspective showing a sliding door with an attached automatic closing device according to the present invention.
Figure 5:
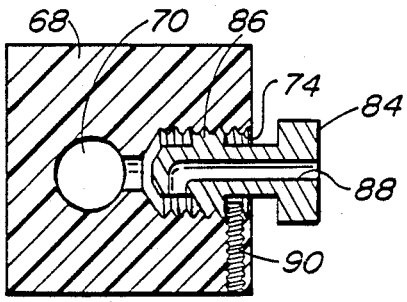
FIG. 5 is a view in section taken along line 5—5 of FIG. 4.

With reference to the drawing, FIG. 1 illustrates a typical sliding glass door assembly 10 comprising a rectangular frame 12 comprised of upper and lower horizontal members 13 and 14 and vertical end members 15 and 16. The frame retains a fixed glass pane 18 and adjacent movable glass door 20 that is supported by the horizontal frame members which include tracks that enable the door to roll from its open and closed positions in the conventional manner. The door is shown in a partially open position as it appears when being closed automatically (as indicated by the directional arrow) by a door closing device 22, embodying principles of the present invention.

Figure 2:
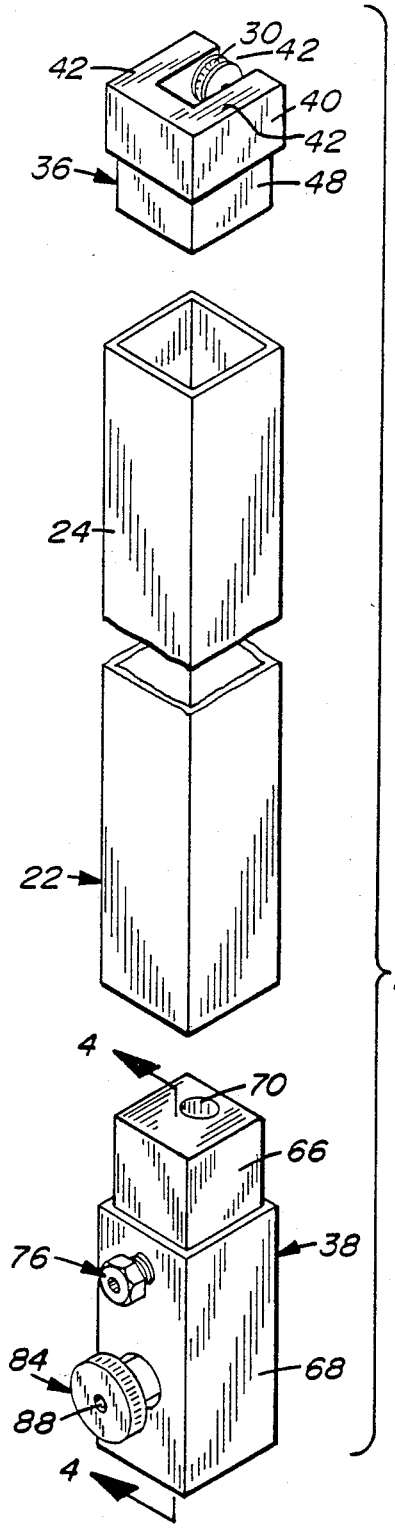
FIG. 2 is a fragmentary exploded view in perspective showing the door closing device of FIG. 1.

In broad terms, the door closing device 22 comprises a tubular housing 24 preferable having a square cross section so that one of its flat, elongated side surfaces can fit against a similarly flat outside surface of the vertical end member 15 of the movable door 20. Originally, or as shown in FIG. 2, the housing 24 is open at both ends and it may be made of a suitable material, such as a durable aluminum alloy. Within the housing is a movable, elongated counterweight 26 which fits snugly within its inner wall surfaces but can readily move with respect to them. The counterweight is connected to a cable 28 which extends upwardly through the housing 24, around a pulley wheel 30 and whose other end is anchored to the upper horizontal frame member 13, as indicated by numeral 32. The pulley wheel 30 is journaled within a first plug-like member 36 that fits within the upper end of the housing. At the lower end of the housing 24 is a second plug-like member 38 that forms an air-tight seal with the lower end of the housing and thus forms a confined air chamber 39 below the counterweight.

Figure 3:
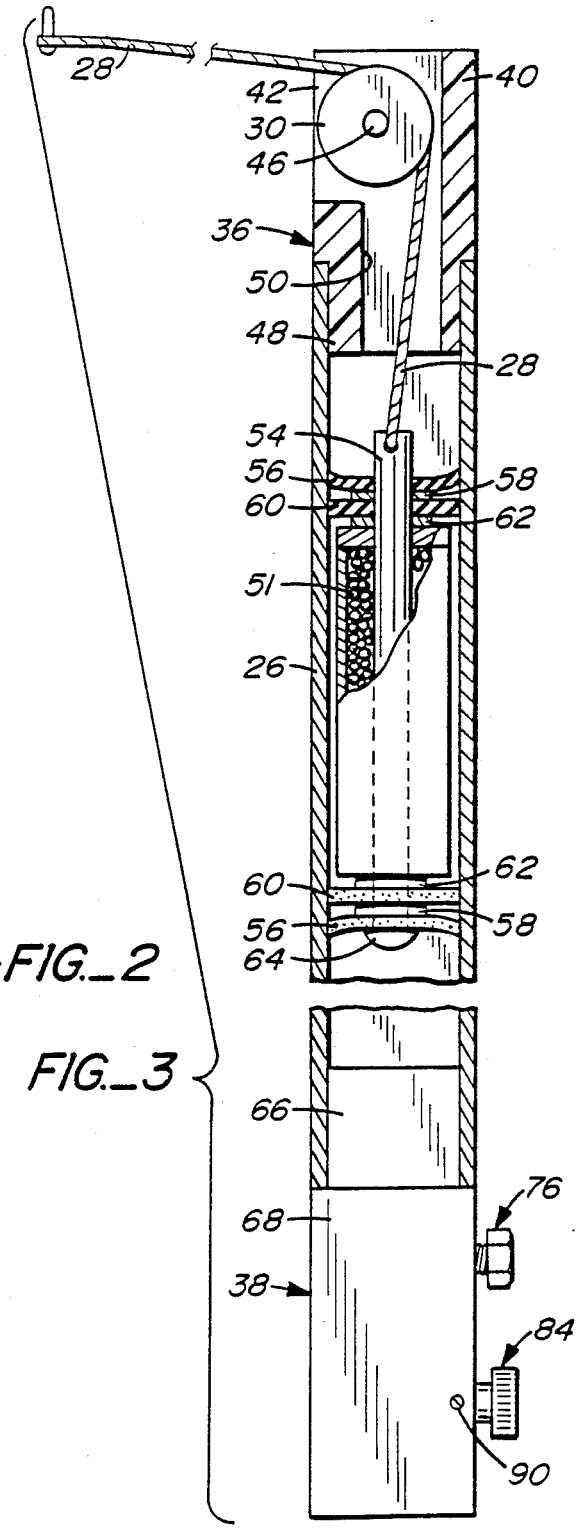
FIG. 3 is a fragmentary view in elevation and in section of the assembled door closing device according to the invention.

As shown in FIGS. 2 and 3, the upper plug member 36 has a general oblong shape with a square cross section. An upper portion 40 has a U-shaped configuration in plan view formed by a pair of spaced apart arm members 42 between which is a space 44 for the pulley wheel 30. A shaft 46 for the pulley wheel is journaled at both ends in the spaced apart arm members so that the wheel is freely rotatable within the space 44. A lower portion 48 of the plug member 36 which is integral with its upper portion 40 also has a square cross-section. The outside dimension of the aforesaid lower portion 48 is such that it will fit snugly within the upper end of the housing 24 and thus hold the plug member 36 firmly in place. The space 44 in the upper portion 40 communicates with an inner longitudinal passage 50 that extends through the lower portion 48 and provides access for the cable 28 with ample clearance. The plug member 36 may be made of various materials, but use of any suitable plastic material that is relatively hard and durable, such as nylon, enables it to be formed with precision and economy.

The counterweight 26 comprises essentially an elongated hollow casing for retaining a relatively heavy material such as lead which may be supplied in any form, either solid or as lead rods or balls 51. If the balls 51 are used, the number of them within the counterweight casing may be varied to provide the desired amount of gravity force for a particular sliding door installation. Anchored within the casing, as by threads in its end cap 52, is a post or rod member 54 that extends upwardly above the upper end of the counterweight and is connected to the cable 28. As the counterweight moves up and down within the housing, little if any air is able to flow past it because of gasket means at its opposite ends. As shown in FIG. 3, each gasket means comprises a first square-shaped gasket member 56 of flexible material such as neoprene whose side dimension is slightly larger (e.g. by 0.003 to 0.005 inches) than the inside dimension of the housing 24. Separated by a washer 58 around the rod 54 is a second, slightly smaller gasket member 60, also of neoprene, whose side dimension is such that it just lightly wipes the inside walls of the housing as the counterweight moves. This second gasket member 60 is preferably separated from the end of the counterweight casing by another washer 62. A similar combination of gasket members and washers is provided at the lower end of the counterweight around a lower rod member 64.

The second plug-like member 38 at the lower end of the housing 16 is also preferably made from a durable plastic material such as nylon, and as previously described it forms an air-tight seal at the lower end of the housing 24. Thus, as shown in FIGS. 2 and 3, the plug member 38 has generally an oblong shape with an upper portion 66 that fits tightly within the lower end of the housing and a larger lower portion 68 whose outside dimensions are the same as the housing.

Figure 4:
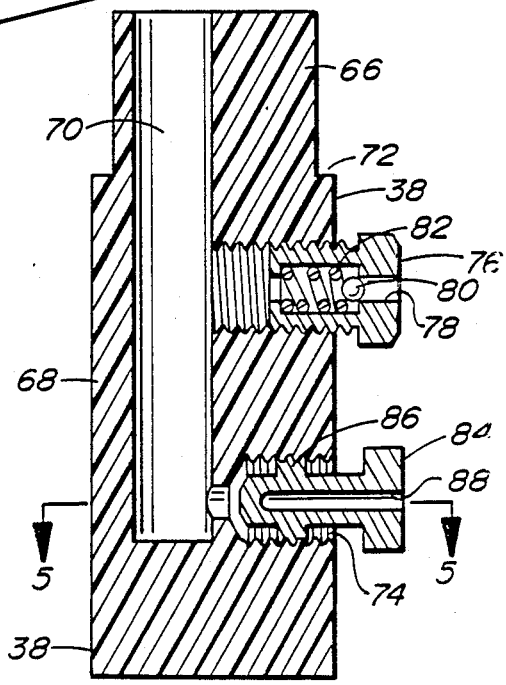
FIG. 4 is a view in section taken along line 4—4 of FIG. 2.

As shown in FIG. 4, an elongated air passage 70 is provided within the member 38 which extends through its upper portion 66 and into its lower portion 68. Connected to the air passage 70 is a first threaded orifice 72, spaced below which is a second threaded orifice 74 connected to the passage 70 by a narrowed passage 73. Within the first orifice is a conventional check valve 76 having a central opening 78 to ambient air outside the housing. Within the check valve is a passage containing a ball 80 which is normally held against the opening 78 by a spring 82. As the counterweight rises within the housing as the door 20 is opened, the chamber 39 below the counterweight 26 increases in volume and this causes the ball 80 to push against the spring 82 and allow air to enter the chamber. When the counterweight moves downwardly as the door is closed, the check valve 76 closes so that the only air which can escape from the chamber below the counterweight must pass through the second threaded orifice 74.

Within the threaded orifice 74 is a controllable, adjustable air bleed valve 84 that has a generally tubular body 85 with an enlarged threaded body portion 86 which engages the threads of the orifice 74. Attached to the outer end of the valve body 85 and extending outside of the orifice 74 is a cylindrical knob portion 87 for the valve 84. Extending through the valve body 85 is a passage 88 whose inlet 89 is at one side of the body and whose outlet is in the knob portion 87. At its inner end, the valve body 85 is tapered to form a frusto-conical end of the orifice 74. As the valve body 85 is rotated to move it axially within the orifice 74, the tapered end of the valve body moves relative to the end of the orifice to vary the size of an air passage 91 that connects the passages 70 and 73 with the outlet passage 88 in the valve body. Thus, the bleed valve 84 can be adjusted within the orifice to the precise axial position that provides the desired rate of air flow from the chamber below the counterweight to thereby control its rate of descent as the door is closing. Extending through the side of the lower portion 68 of the plug member 38 is a threaded set screw 90 whose inner end engages the valve body 85 when it is positioned at a desired location. Once the desired position for the bleed valve has been established, the set screw 90 can be tightened to retain the valve body 85 in place.

The installation of the door closing control device on an existing sliding door system can be performed rapidly with relatively simple tools and unskilled labor. Essentially, it is necessary only to anchor the cable 28 in the upper horizontal frame member 13 and then to attach the housing assembly 24, with the counterweight 26 and end plug members 36 and 38 in place, against the side surface of a vertical frame member 15. This attachment procedure may be accomplished using suitable fasteners or an adhesive material between abutting surfaces of the housing 24 and the adjacent vertical frame member 15. The end plug members 36 and 38 are sized to be flush with the outer surfaces of the housing and they can be painted the same color so as to appear integral therewith. Since the housing itself may be made of the same material as the door frame, it may appear, when installed, to be part of the original door structure and thus highly acceptable cosmetically. For original door construction, the housing may be designed to be part of the door frame and thereby require even less space.

In operation, the closing device may be easily adjusted and/or serviced because the check valve 76 and the bleed valve 84 are readily accessible at the base of the housing. No more than ordinary finger pressure or a small screwdriver is required to make normal adjustments.

The preferred embodiment described herein is intended to be purely illustrative, and not limiting of the scope of the invention. Other embodiments and variations will be apparent to those skilled in the art and may be made without departing from the essence and scope of the invention as defined in the following claims.

What is claimed is:

1. An automatic closing device for a sliding door having upper and lower horizontal frame members interconnected by vertical frame members and supported between upper and lower track members, said closing device comprising:

an elongated tubular member;

a counterweight movable within said tubular member and forming a variable air chamber below the counterweight as it moves within the tubular member;

sealing means on said counterweight for preventing any bypassing of air as said counterweight moves within said tubular member said sealing means comprising a pair of spaced apart gasket members fixed to at least one end of said counterweight;

a flexible cable attached at one end of said counterweight and having an opposite end adapted to be anchored to said upper track member at a preselected location;

an upper end element in said tubular member including a pulley wheel for supporting said cable between its ends;

a lower end element in said tubular member forming an air tight seal therewith;

check valve means on said lower end element for allowing outside air to flow into said chamber within said tubular member while preventing air flow out of said chamber;

bleed valve means on said lower element for allowing air to flow out of said chamber at a restricted rate so as to control the downward travel of said counterweight within said tubular member when said door is closed.

2. The closing device as described in claim 1 wherein said pair of gasket members comprises a first gasket member whose planform dimensions are slightly greater than the internal cross-sectional dimensions of said tubular member, so as to provide an interference fit therewith, and a second gasket member having planform dimensions slightly less than those of said internal cross-sectional dimensions of said tubular member so as to provide a wiping action on the internal wall surfaces of said tubular member as the counterweight moves up and down therein.

3. The closing device as described in claim 1 wherein a pair of said gasket members are provided at both upper and lower ends of said counterweight.

4. The closing device as described in claim 1 wherein said tubular member, said upper and lower end elements and said counterweight all have rectangular cross-sections.

5. The closing device as described in claim 4 wherein said upper end element comprises an integral oblong member having an upper portion with spaced apart wall portions, a shaft journaled in said wall portions for supporting said pulley wheel, and a lower portion extending below said upper portion extending into the upper end of said tubular member.

6. The closing device as described in claim 5 wherein said upper end element is made of plastic material and has an upper portion whose cross-section has the same dimensions as the cross-section of said tubular member.

7. The closing device as described in claim 4 wherein said lower end element is made of plastic material and has an upper portion whose cross-section has the same dimensions as the cross-section of said tubular member.

8. The closing device as described in claim 4 wherein said bleed valve means is adjacent to said check valve means in said lower end element and comprises an elongated valve body threadedly engaged in an orifice and having a central passage in communication with said chamber, said valve body also having a tapered inner end portion forming a variable, connecting air passage with said central passage whose size can be adjusted when the valve body is moved to control the rate of air flow through said bleed valve as the door is closing.

9. The closing device as described in claim 8 including a set screw for holding said valve body of said bleed valve means in a preset position to maintain a desired door closing rate.

* * * * *